United States Patent [19]

Van Lysel

[11] Patent Number: 4,961,582

[45] Date of Patent: Oct. 9, 1990

[54] GEOGRAPHICAL TRAVEL GAME

[76] Inventor: Stephen P. Van Lysel, 245 Swanton Rd., Apt. 6, Madison, Wis. 53714

[21] Appl. No.: 408,182

[22] Filed: Sep. 15, 1989

Related U.S. Application Data

[63] Continuation-in-part of Ser. No. 198,935, Oct. 3, 1988, abandoned.

[51] Int. Cl.[5] ..... A63F 3/04

[52] U.S. Cl. ..... 273/254

[58] Field of Search ..... 273/250–254, 273/249, 243

[56] References Cited

U.S. PATENT DOCUMENTS

| | | | |
|---|---|---|---|
| 940,855 | 11/1909 | Clemens | 273/252 |
| 3,638,946 | 2/1972 | Bain | 273/254 |
| 3,883,142 | 5/1975 | Spohn | 273/251 |
| 4,052,071 | 10/1977 | Siegfried | 273/254 |
| 4,061,336 | 12/1977 | Lincoln | 273/254 |

FOREIGN PATENT DOCUMENTS

| | | | |
|---|---|---|---|
| 915550 | 1/1963 | United Kingdom | 273/254 |
| 1192400 | 5/1970 | United Kingdom | 273/254 |

*Primary Examiner*—Benjamin Layno

[57] ABSTRACT

A board game including a playing board with a large map of western Europe which is bordered by thirteen blocks that run along both the bottom and the left hand side of the playing board. The playing map is divided into sixteen European countries which includes forty nine European cities. Players start from the bordering blocks and play proceeds onto any city the player chooses. Once in a city the player draws the corresponding city card. Players move on to other cities and other countries as the object is to collect a specified number of each of seven various goals. Die is used to determine play. Layover cards and Altered Schedule cards contain instructions which alter regular play. Play money is used for fees, rewards and penalties.

1 Claim, 5 Drawing Sheets

BERN

1. Walk through Bern for the best way to take it in. Stop at the cathederal (münster) and climb up the 254 steps to the top of one of the towers. When you get back down play a game of chess with people-sized chessmen within sight of the cathederal. Continue your tour down the arcaded medieval main street past the fashionable shops and the Clock Tower. Be here on the hour to watch the clock's mechanical puppet show. Absorb the cities atmosphere more in the evening at an outdoor cafe on the Kramgasse, with the aid of a couple of Cardinal beers.

COLLECT LEISURE DAY

2. Make your way to Murten bringing along some fresh-baked bread, cheese, salami and fruit as well as a bottle of local white wine. Check out the town and then have your lunch along the lake. When you're finished, walk along the lake to see why this is such a popular spot with the locals.

COLLECT LEISURE DAY

3. Head to Interlaken to embark on a thrilling rail trip to the highest railway station in Europe (11,333 feet). The view from the top can not be duplicated and any description would not be fair to the Jungfraujoch. Be smart and bring warm clothing so your experience will be a comfortable one.

COLLECT NATURE'S GRACES —75

4. Visit Zermatt where you don't have to know how to ski in order to enjoy your stay. Walk along the numerous paths and every view you get will be one you will want to remember. Once back in Zermatt, relax at a restaurant with an order of rösti, and a Feldschlösschen beer. If you have a car pay $50 for parking as cars are not allowed in Zermatt.

COLLECT NATURE'S GRACES

5. Spend the morning at the twice-weekly farmers market in front of the Swiss parliament building, and bring your camera. Then head to the Bern Historical Museum and later the fine Arts Museum. Bern has nine museums to choose from, but you should not miss the Historical Museum. After a fondue dinner sit back with a coffee-schnaps and then make it to a cellar pub to check out the nightlife.

6. See what the city of Luzern has to offer. Stroll over the Chapel Bridge and walk along the ancient city walls. Make certain to give yourself ample time to discover the Swiss Transport Museum. For dinner have a Gemischter Salat (German Salad) and a Bernerplatte if your appetite is big enough.

Fig. 9

GEOGRAPHICAL TRAVEL GAME

This application is a continuation-in-part of original application Ser. No. 07/198,935 filed Oct. 3, 1988 now abandoned.

BACKGROUND OF THE INVENTION

1. Field of the Invention

Board games are very common today and can be found in numerous forms and with many variations. Some board games are created solely to entertain while others are invented in order to educate the players while they are having fun. Geographical board games enable individuals to become familiar with the geography of a specific area while at the same time entertaining anywhere from two to a large group of people. The introduction of a die into the game allows for the elements of chance, while a strategy must also be created and followed in order to obtain a set goal and be declared the winner.

2. Description of the Prior Art

Other games have been patented which are based on travel through a designated geographical territory. For instance U.S. Pat. No. 940,855 by Allen B. Clemens is a geographical travel game that uses a map of western Europe for its playing surface. Mr. Clemens' invention has predetermined routes of travel which the players use and the game can only be played by as many players as there are routes on the playing map. The goal of Mr. Clemens' invention is to reach a specific destination before other players reach their specific destination. Thus, the only matter of importance for the players is the speed in which they travel while the experiences one gains while traveling does not help a player win the game.

U.S. Pat. No. 3,638,946 by Bruce N. Bain also describes a geographical travel game. This invention puts great emphasis on scheduling and planning as well as the mode of transportation players use. Speed of travel is important as the winner of the game is the first player to get to a predetermined number of destinations. There is little or no importance placed on what players could see while at these destinations, in fact there is no mention of travel sights.

U.S. Pat. No. 3,883,142 by Robert H. Spohn is a travel board game in which players are limited to travel along marked paths and the game is limited to play in one city. The type of travel used is very basic to this invention and money plays a central role as well. Charges for admission to attractions and for services make it essential for players to closely monitor their budget.

U.S. Pat. No. 4,052,071 by Jack Siegfried is another travel board game which places no emphasis on travel sights. Players proceed from destination to destination and the winner is determined by how much money players collect as well as by how many destinations they have reached. Players do not receive information an travel sights as they play this game.

U.S. Pat. No. 4,061,336 by Launa J. Lincoln is another board game which centers on the actual traveling between destinations. The object of the game is to accumulate the most money while visiting or discovering travel sights are not of importance to this invention. Players do not enjoy the opportunity of advancing their knowledge of travel sights or monuments although they do advance their knowledge of a particular geographic area.

Foreign Pat. No. 1,192,400 by Jan Tramer and Kenneth Rowland Mayhew is a travel game which does give information on travel sights and landmarks. However, the invention is limited to play in one city and players must use a predetermined route. There is also not a diversity of goals that players are to obtain, such as leisure time or night life. These opportunities can be just as important to a traveler as visiting a landmark could be and are often overlooked by a first time travelers.

Foreign Pat. No. 915,550 by Kenneth Graham Hughes is another travel board game where the goal is to travel to a predetermined number of places as quickly as possible. The invention does not contain information on travel sights and it also ignores a basic traveling rule. That rule states that the more destinations visited does not always make the best traveling experience.

SUMMARY OF THE INVENTION

The object of the invention is to provide a new travel game which educates the players as to the travel opportunities that are available to them. Whereas other travel games emphasize traveling from one location to another, this invention is primarily focused on the travel sights available at specific locations. In order to accomplish this goal the invention must be fun to play so that players will really want to play the game. The simplicity of this invention and its rules will add to the overall fun of the game.

The invention is played on a flat playing board which has a map of Europe on it and a total of thirteen starting blocks that run along the bottom, and the left hand side of the playing board. After a player has advanced past the starting blocks they proceed immediately onto the playing map. Once on the playing map players can move freely while inside any country they choose to visit. Players roll a die to determine what they will do on a particular day. One roll of the die equals one day of travel time. On certain days players sometimes obtain specific goals. The first player to obtain a set amount of each of the seven categories of goals wins. The invention includes one die which gives the game the element of chance. There are also forty nine city cards, twenty five Altered Schedule cards and twenty five Layover cards. The city cards list six daily activities for each city and tell the player what their activities are for that play. A player rolls the die once for each turn. If a player rolls the same number on the die while at the same city they must draw an Altered Schedule card and follow its instructions. Layover cards are drawn when a player attempts to move to a new country but they do not roll the proper number on the die. Play money is also included in the contents of this game. The details of the actual operations of the invention will be described later in more depth. However, it is important to understand that this invention is not a board game based on traveling from one destination to another, but rather a board game that familiarizes players with famous landmarks, historical sights and nature's wonders which are located in Europe. There are also numerous travel tips that make this invention as educational as a traveling guide book.

DESCRIPTION OF THE DRAWINGS

FIG. 9 is a front and back view of one of the city cards which are used in the game. There are forty nine city cards overall.

DESCRIPTION OF THE PREFERRED EMBODIMENT

Figure 1:
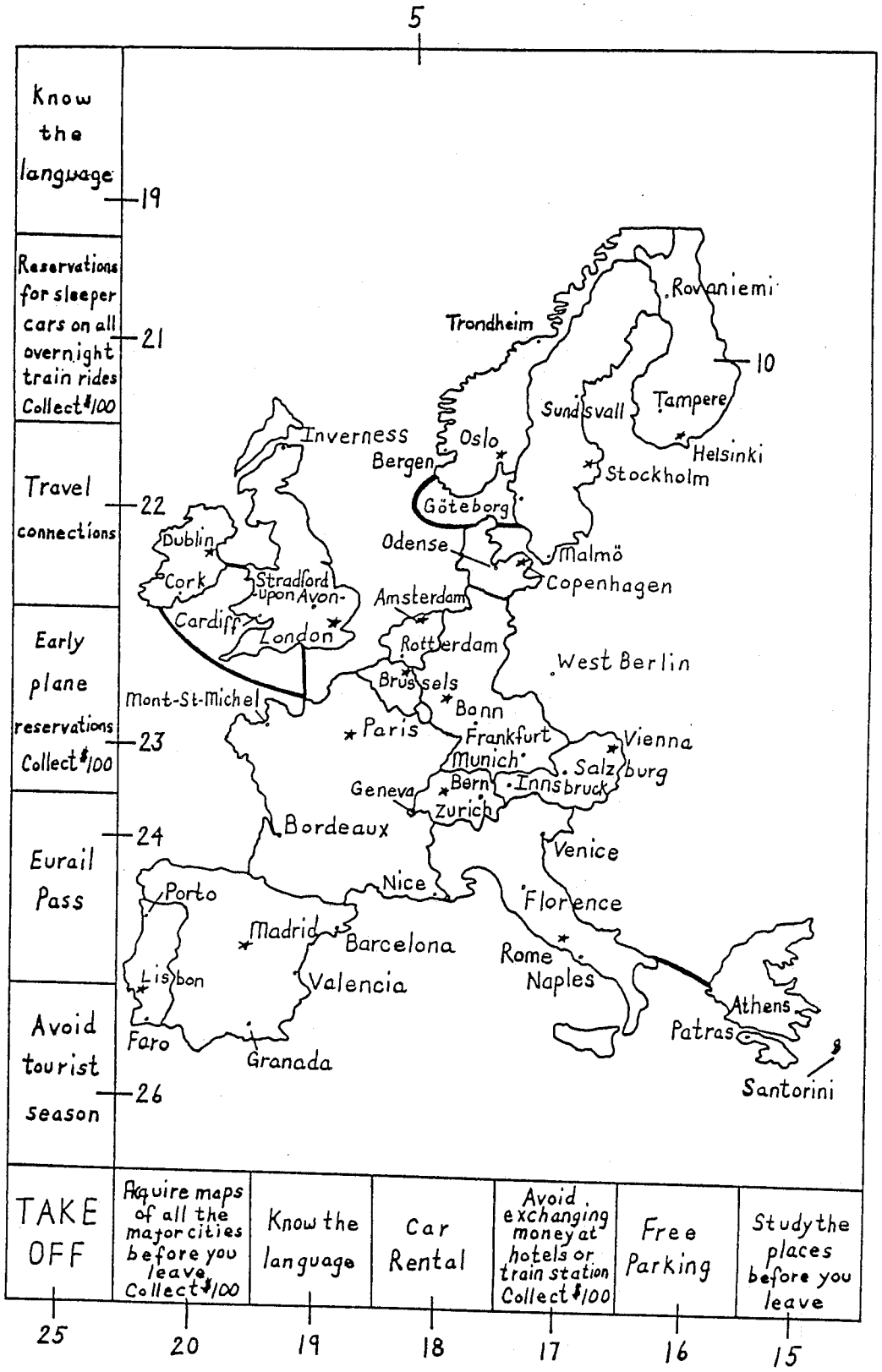
FIG. 1 is a view of the playing board showing a map of Europe surrounded by thirteen blocks which run along the bottom and the left hand side of the playing board.
Figure 2:
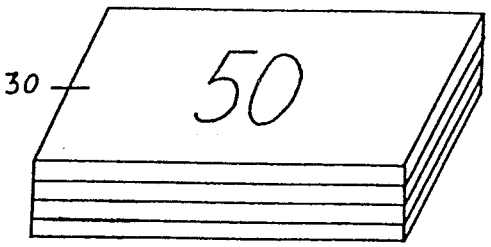
FIG. 2 is a view of the play money which is used in playing the game.
Figure 4:
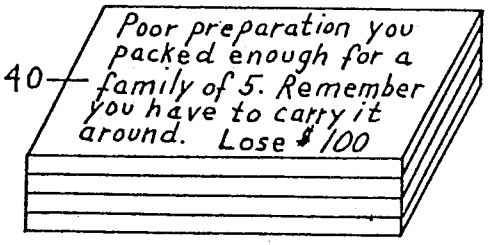
FIG. 4 is a view of a stack of the Layover cards and shows the backside of one of the actual cards.
Figure 6:
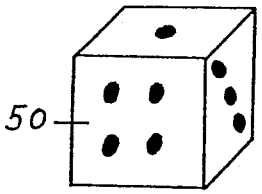
FIG. 6 is a view of the die that is used in playing the game.
Figure 5:
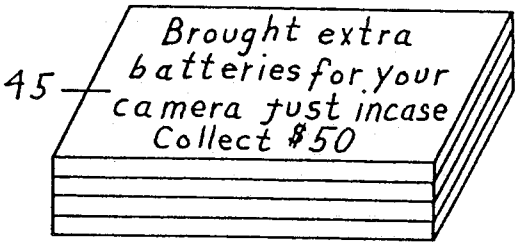
FIG. 5 is a view of a stack of the Altered Schedule cards and shows the backside of one of the actual cards.
Figure 3:
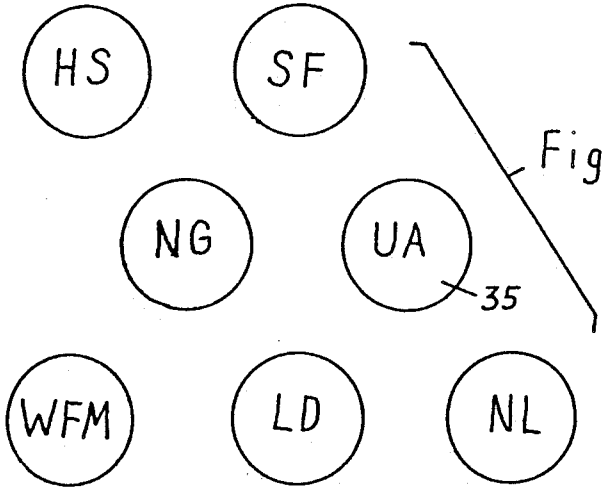
FIG. 3 is a view of the tokens players receive when they obtain a goal.
Figure 8:
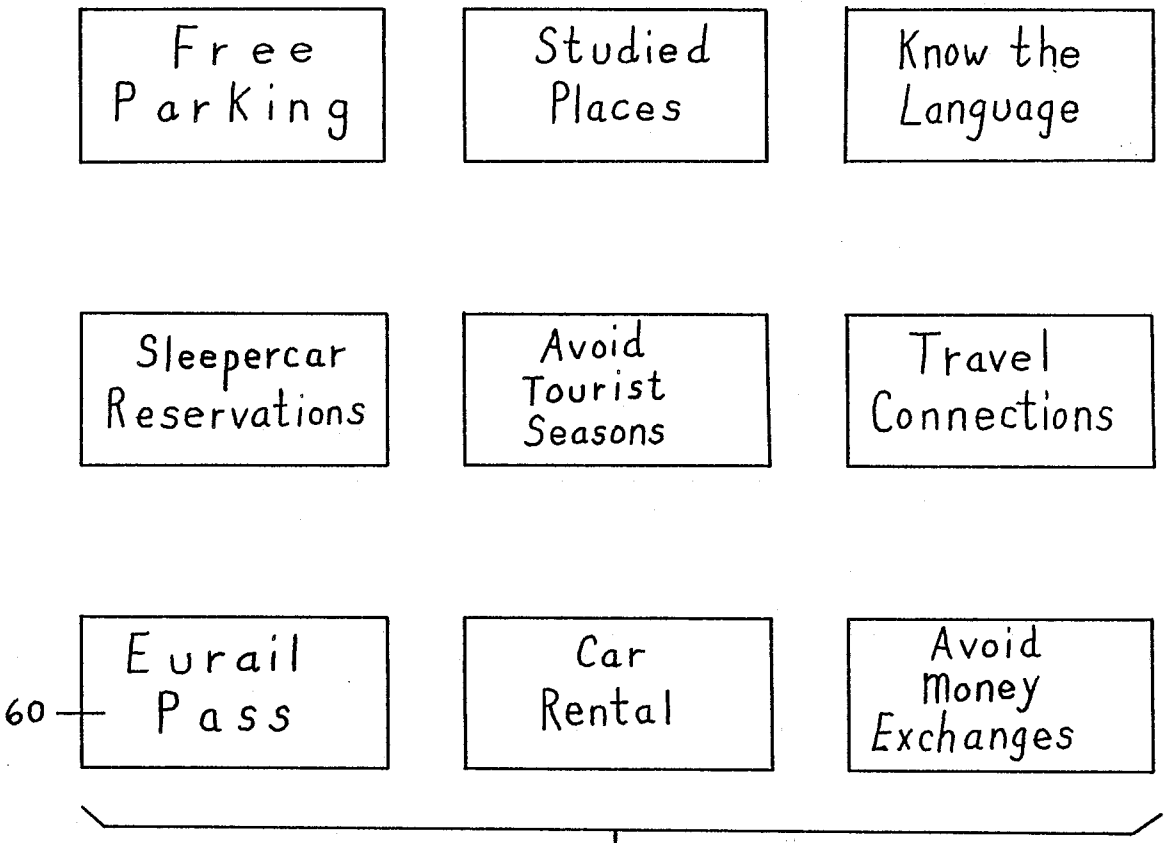
FIG. 8 is a view of the nine various tokens which players may collect by landing on the corresponding starting blocks.
Figure 7:
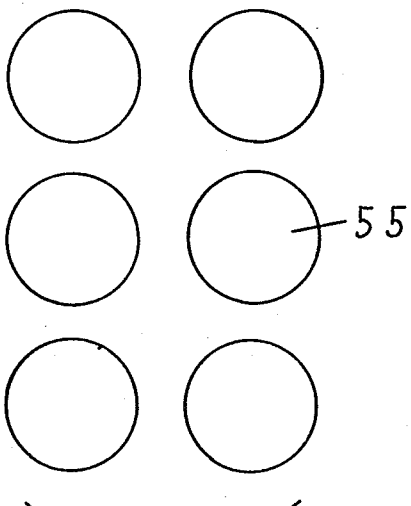
FIG. 7 is a view of the six playing pieces which are used to indicate the players actual playing position on the playing board.
Figure 10:
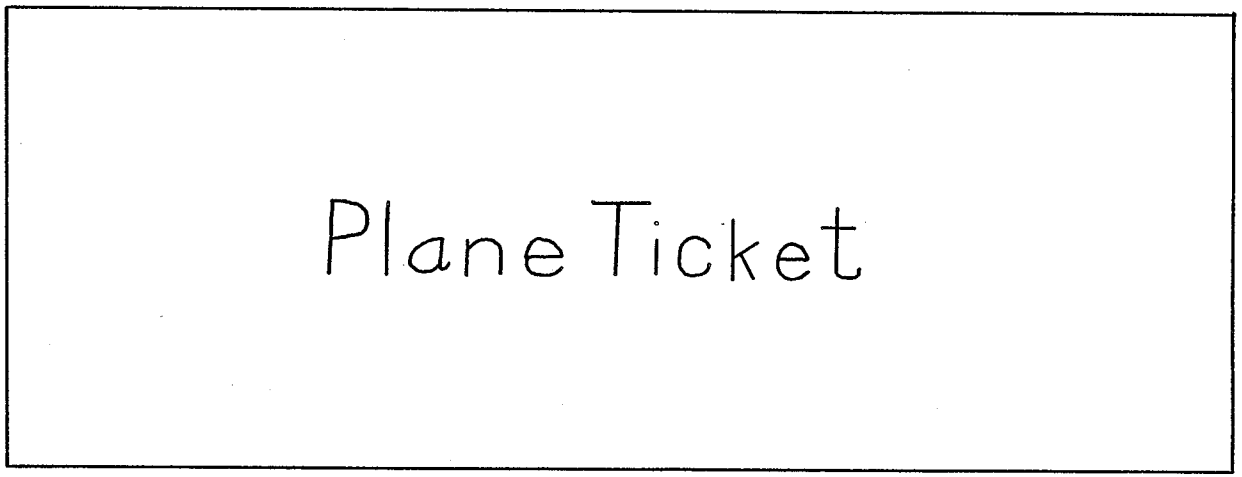
FIG. 10 is a view of a plane ticket which may be purchased.

The playing board 5 includes a large map of western Europe 10 which is boarded by thirteen starting blocks 15,16,17,18,19,20,21,22,23,24,25,26 that run along the bottom of the playing board as well as the left hand side of the playing board. Playing pieces 55 are used to indicate each players position on the playing board 5. The playing pieces are of six different colors to differentiate between the various players. To begin play of the game the players roll the die 50, which is of the ordinary type. The player who rolls the highest number will start first. If two or more players tie, these players roll again. All players place their playing piece on the Take Off starting block 25 which is in the bottom left hand corner of the playing board 5. The player who has been determined to start first rolls the die. After the roll the player may decide to proceed along the starting blocks that go up the playing board, or the player may decide to proceed along the starting blocks that go along the bottom of the playing board. The player moves the number of starting blocks which corresponds to the number they rolled on the die. Whatever starting block the player lands on they collect a token 60 indicated by the starting block. These tokens may be used at any time during the game. Exceptions to this rule are Car Rental tokens and Eurail Pass tokens which are kept throughout the game. If a player does not land on a Car Rental or Eurail Pass starting block they must purchase one or the other for $500. Players can not purchase both. Tokens as well as money can be collected by players as they move along the starting blocks.

After the first player has rolled the die, landed on a starting block and collected the appropriate token, the next player takes their turn in the same manner. Once play comes back to the starting player they will roll the die again. If the player lands on another starting block, they proceed exactly in the manner of their first turn. If on the other hand a player rolls a number on the die which places them past the starting blocks, the player places their playing piece on any city they choose which is on the playing map 10 and await their next turn. The player will not return to the starting blocks at any time during the remainder of the game. The tokens and money collected as the player proceeded along the starting blocks assist the player in their attempt to win the game.

While at a city the player picks up the city card 75 that corresponds to the city they are in. A player rolls the die and reads the number on the city card that corresponds to the number on the die. One roll of the die equals one day of travel activities. A player rolls the die once for each turn unless they are instructed by an Altered Schedule card, Layover card or city card to do otherwise. On certain rolls of the die the city card may instruct the player to collect a specific goal token. The first player to collect the specified number of each of the seven various goals is declared the winner. If a player rolls the same number on the die while they are at a particular city, the player must draw the top card from the Altered Schedule deck and follow its instructions. This is true even if the player rolls a specific number on the die while at a particular city, leaves that city and comes back to the city later. If that specific number on the die is rolled again, the player must draw a card from the Altered Schedule deck. Players may move freely to any city that is within the country they are in as long as the player announces their intention to do so before they roll the die. Players may move to a new country that is either physically touching the country they are in, or to a country that is connected by a black line to the country they are in. Players move to the new country by announcing their intention to do so before they roll the die, and then the player must roll a number six on the die 50. After the player rolls a number six, the player moves to any city they wish within the new country and await their next turn. If the player does not roll a number six on the die, the player must draw the top card from the Layover deck and follow its instructions. The player then awaits their next turn and again attempts to roll a number six on the die. If after three attempts the player has not rolled a number six, the player will pay $100, move to the new country and awaits their next turn. A Layover card is not drawn after this third roll. Once a player has announced their intention to move to a new country, they must carry out their announced intention.

Play money 30 is used. Each player collects $1,500 from the bank at the beginning of the game. Play money is used to pay penalties or to collect rewards that may result from drawing an Altered Schedule card, a Layover card or a city card. Money is also used to purchase either a Eurail Pass or a Car Rental if a player does not collect one or the other while moving along the starting blocks. A player may use money to purchase a plane ticket also. A plane ticket costs $500 and is used at any time a player is in a capital city. The player may move to any other capital city, hand in their plane ticket and await their next turn.

If a player losses all their money at any time during the game, that player must forfeit three goal tokens of the other players choosing. If the bankrupt player does not have three goal tokens to forfeit, they must lose a turn for every goal token they can not hand over. The forfeited goal tokens are turned over to the bank. The bankrupt player then collects $500 from the bank. If this amount is not enough to withdraw the player from debt, three tokens are forfeited for every $500 needed. Players are not allowed to sell tokens to the bank. Tokens are only handed over to the bank for money when a player becomes bankrupt.

The specific goal of the game is to collect four Historical Sights goals, seven Leisure Day goals, three Night Life goals, three Sun and Fun goals, three Nature's Graces goals, two Unique Adventures goals, and two World Famous Museums goals. The first player to collect the required number of each of these goals is declared the winner. It does not help to collect more than the required amount of any of the goals. This invention is designed for two or more players.

What is claimed is:

1. A board game comprising: a playing surface including a geographical map having designated thereon a plurality of countries and a plurality of cities;

a plurality of playing pieces for designating the positions of players on the playing surface;

a chance means for determining the movement of the playing pieces from one country to another country, said chance means having a plurality of different numbers and used for randomly selecting a number;

a plurality of city cards, every city on said map having a corresponding city card wherein when a player is positioned on a city, that player picks the corresponding city card;

a plurality of different sets of goal tokens, wherein one set of goal tokens has indicia representing a vacation activity and the other sets of goal tokens have different indicia representing different vacation activities;

each city card comprises a plurality of different instructions including instructions for receiving goal tokens, each instruction on each city card corresponds to a different number on said chance means wherein goal tokens are obtainable on certain number selections of the chance means, the first player receiving a predetermined number of goal tokens from each set being declared the winner.

* * * * *